US007744703B2

(12) United States Patent
Imai et al.

(10) Patent No.: US 7,744,703 B2
(45) Date of Patent: Jun. 29, 2010

(54) FE-BASED AMORPHOUS ALLOY STRIP

(75) Inventors: Takeshi Imai, Kitakyushu (JP); Shigekatsu Ozaki, Kitakyushu (JP); Yuuji Hiramoto, Kitakyushu (JP); Yuichi Sato, Futtsu (JP); Hiroaki Sakamoto, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 254 days.

(21) Appl. No.: 11/887,705

(22) PCT Filed: Apr. 5, 2006

(86) PCT No.: PCT/JP2006/307685

§ 371 (c)(1),
(2), (4) Date: Nov. 16, 2007

(87) PCT Pub. No.: WO2006/109813

PCT Pub. Date: Oct. 19, 2006

(65) Prior Publication Data

US 2009/0242082 A1 Oct. 1, 2009

(30) Foreign Application Priority Data

Apr. 8, 2005 (JP) ..... 2005-111674
Apr. 15, 2005 (JP) ..... 2005-118272

(51) Int. Cl.
*C22C 45/02* (2006.01)

(52) U.S. Cl. ..... 148/403; 148/304; 420/9; 420/87

(58) Field of Classification Search ..... None
See application file for complete search history.

(56) References Cited

U.S. PATENT DOCUMENTS

| | | | | |
|---|---|---|---|---|
| 4,623,408 | A * | 11/1986 | Karamon et al. | 148/403 |
| 5,225,006 | A * | 7/1993 | Sawa et al. | 148/304 |
| 5,370,749 | A | 12/1994 | Ames et al. | |
| 2004/0140016 | A1 * | 7/2004 | Sakamoto et al. | 148/304 |

FOREIGN PATENT DOCUMENTS

| | | | |
|---|---|---|---|
| JP | 57-137451 | | 8/1982 |
| JP | 59-016947 | | 1/1984 |
| JP | 60-1373 | | 1/1985 |
| JP | 62-74049 | A | 4/1987 |
| JP | 62-074050 | | 4/1987 |
| JP | 62-077443 | * | 4/1987 |
| JP | 62-86146 | A | 4/1987 |
| JP | 03-500668 | | 2/1991 |
| JP | 3-68108 | B2 | 10/1991 |
| JP | 03-264654 | | 11/1991 |
| JP | 08-15193 | | 1/1996 |
| JP | 09-095760 | | 4/1997 |
| JP | 9-202946 | A | 8/1997 |
| JP | 2708410 | A | 2/1998 |
| JP | 10-277710 | A | 10/1998 |
| JP | 2001-279387 | | 10/2001 |
| JP | 2004-066294 | | 3/2004 |
| WO | 89/03436 | | 4/1989 |

OTHER PUBLICATIONS

Japanese Office Action dated Nov. 11, 2008 issued in corresponding Japanese Application No. 2006-085785.

K.V. Rao et al. "Crystallization Processes in Nitrogen-Bearing Fe-V-B-Si Amorphous Alloys: Magnetic, Thermal, and Transport Properties" Journal of Non-Crystalline Solids, vol. 61 & 62 (1984) pp. 853-858.

Japanese Office Action dated Apr. 21, 2009 issued in corresponding Japanese Application No. 2006-085785.

Liebermann "Nitrogen as an Alloying Element in Some Metallic Glasses", Journal of Materials Science, 1982, vol. 17, No. 4, pp. 1195-1200.

* cited by examiner

*Primary Examiner*—George Wyszomierski
(74) *Attorney, Agent, or Firm*—Kenyon & Kenyon LLP

(57) ABSTRACT

The present invention provides a Fe—B—Si system amorphous alloy thin strip excellent in high magnetic flux density, thermal stability, amorphous formability improved workability and low core loss. The present invention further provides a Fe—B—Si system amorphous alloy thin strip which has the reduced cost without using high purity iron resources such as an electrolytic iron as iron resources used in an amorphous alloy thin strip, and also has core loss less than 0.10 W/kg at $W_{13/50}$ in soft magnetic property in alternating-current field. The Fe—B—Si system amorphous alloy thin strip according to the present invention contains an appropriate amounts of N, C, P to improve thermal stability, amorphous formability, workability (brittleness), and core loss without deteriolating magnetic flux density, and contains, in atomic %, B: 5-25%, Si: 1-30%, N: 0.001-0.2%, C: 0.003-10%, P: 0.001-0.2% and the balance being Fe and unavoidable impurities, and optionally contains Co or Ni substituted to less than 15% of the Fe amount, or Cr at less than 5% substituted to the Fe amount. Further, Mn: 0.15-0.5 mass %, S: 0.004-0.05 mass % can be included.

3 Claims, No Drawings

FE-BASED AMORPHOUS ALLOY STRIP

TECHNICAL FIELD

The present invention relates to an Fe-based amorphous alloy strip used for iron cores of power transformers, high frequency transformers, etc. In particular, it relates to an Fe-based amorphous alloy strip provided with a high flux density and superior in heat stability, amorphous phase forming ability, workability, and watt loss. Further, it relates to an amorphous metal alloy strip not using electrolytic iron or another high purity iron source as the iron source for the strip alloy, reducing the cost of the strip alloy, and having a soft magnetic property watt loss W13/50 of a stable 0.10 W/kg or less.

BACKGROUND ART

As methods for quenching an alloy from a molten state so as to continuously produce strip or wire, the centrifugal quenching method, single roll method, twin roll method, etc. are known. These methods eject molten metal from an orifice etc. to the inner circumference or outer circumference of a metal drum rotating at a high speed so as to rapidly solidify the molten metal and produce strip or wire. Further, by suitably selecting the alloy composition, an amorphous alloy similar to liquid metal can be obtained and a material superior in magnetic properties or mechanical properties can be produced.

This amorphous alloy strip is considered promising as an industrial material in numerous applications due to its superior characteristics. In particular, for applications for iron core materials for power transformers, high frequency transformers, etc., due to the low watt loss, high saturated flux density and permeance, and other reasons, Fe-based amorphous alloy strip, for example, Fe—B—Si-based strip, is employed.

As the technical issues involved in use of amorphous alloy strip as the material for iron cores of power transformers, high frequency transformers, etc., there are the greater amount of material used when producing the transformers, for example, the iron core and copper wire, and the higher production costs compared with use of silicon steel plate. This is due to the fact that most amorphous alloy strips are small in saturated magnetizing force and therefore the design flux density of the transformer has to be lowered. As a result, the cross-sectional area of the iron core becomes larger.

Therefore, various studies have been conducted on improving the flux density of amorphous alloy strip. For example, Japanese Patent Publication (A) No. 03-264654 proposes an amorphous alloy strip comprised of a composition of $Fe_{80}B_{20}$ wherein a saturated flux density of 1.57 to 1.61 T (Tesla) is obtained and Si and P are added to improve the embrittlement temperature and ductility. Further, in Japanese Patent Publication (A) No. 03-500668, a high flux density was confirmed due to the addition of Co in an Fe—B—Si—C-based amorphous alloy strip, but Co is an expensive element, so there are cost difficulties. Therefore, as a system of ingredients able to realize high flux density without use of Co, Hatta et al.: JEEEE Trans. Magnetics MAG-14 (1978) 1013 introduces an Fe—B—C-based amorphous alloy strip. It is reported that with this system of ingredients, a 1.78 T saturated flux density is achieved, but there are the problems that the watt loss is poor compared with an Fe—B—Si—C-based amorphous alloy strip and that the heat stability, as represented by the stability of the magnetic characteristics at the time of annealing and the time of transformer operation, is low in level.

Further, Japanese Patent Publication (A) No. 09-95760 proposes that the allowable amounts of the contents of S, Mn, and other impurity elements be increased by the addition of a slight amount of P: 0.008 to 0.1 wt %, but the effect on the heat stability and workability (brittleness) accompanying the addition of P is not evaluated. Further, Japanese Patent Publication (A) No. 62-74050 proposes adding N to an amorphous alloy strip containing Cr so as to raise the hardness of the strip and improve the maximum permeance and watt loss, but the problems of heat stability and workability are still not solved.

Further, when producing Fe—B—Si-based amorphous strip, it had been thought that impurities degraded the watt loss etc., so in the past alloy materials with impurities kept extremely low had been used. That is, as the iron source, electrolytic iron had been used.

As the specifically suppressed impurities, for example, there are P and S. Japanese Patent Publication (A) No. 59-16947 limited P to 0.015 wt % or less and S to 0.02 wt % or less. This publication describes P as an element degrading the watt loss and further S as an element promoting brittleness. The composition is prescribed as Fe: 86 to 95 wt %, B: 2 to 4 wt %, Si: 0 to 11 wt %, and C: 0 to 1.5 wt %. If converting these to atm %, wide ranges of Fe: 65.9 to 85.4 atm %, B: 8.3 to 17.6 atm %, Si: 0 to 18.3 atm %, and C: 0 to 6.1 atm % are taken.

Further, Japanese Patent Publication (A) No. 57-137451 shows the maximum allowable amounts of various impurity elements in FeSiB-based amorphous strip. For example, it prescribes P: 0.008 atm % or less, Mn: 0.12 atm % or less, and S: 0.02 atm % or less. This publication prescribes Fe: over 78.5 atm % to less than 80 atm %, B: 13 atm % to 16 atm %, and Si: 5 atm % to 10 atm %, so if converting the maximum allowable amounts of the impurity elements into wt %, they become P: 0.0053 wt % or less, Mn: 0.14 wt % or less, and S: 0.0136 wt % or less. This publication as well considers the impurity elements to be elements degrading the characteristics.

The allowable amounts of the impurities in the case of producing amorphous alloy strip are considerably small as shown in these Japanese Patent Publication (A) No. 59-16947 and Japanese Patent Publication (A) No. 57-137451, so it had been thought difficult to use the steels produced by usual steelmaking processes from iron ore for the iron source of amorphous alloy strip. The reason is that these iron sources include more than the allowable amounts of impurities.

That is, in the past, the allowable amounts of the impurity elements were considerably low, so electrolytic iron and other high purity iron sources had to be used. High purity iron sources are expensive, so the strip alloy cost became high. This became a factor raising the cost of production of strip. To promote the broader use of strip as an industrial material, the production cost has to be reduced. For this purpose, it has been strongly desired to reduce the strip alloy costs. Further, in the past, the characteristics varied in the same lot. This became a factor lowering the yield and raising the production costs.

Therefore, the applicant previously proposed in Japanese Patent Publication (A) No. 09-202946 an alloy strip exhibiting excellent characteristics without using electrolytic iron or another high purity iron source as the material for the strip alloy, that is, even if using an inexpensive iron source. That is, they proposed an Fe-based amorphous alloy strip consisting of strip comprised of main elements of Fe, B, Si, and C and impurities characterized in that the composition of the main elements is expressed by FeaBbSicCd, where a, b, c, and d are, by atm %, $80<a\leqq 82$, $14\leqq b\leqq 16$, $2\leqq c<5$, and $0.02\leqq d\leqq 4$, and by containing as impurities, by wt %, P: 0.008% to 0.1%, Mn: 0.15% to 0.5%, and S: 0.004% to 0.05%.

This invention was made based on the finding that if including a slight amount of P, even if Mn, S, and other impurities are included in greater amounts than the past, the characteristics of the strip will not degrade, so use of a low grade iron source containing a certain extent of impurities becomes possible. In general, low grade iron sources are inexpensive, so the strip alloy costs can be reduced.

Further, in an ingredient system containing slight amounts of P, Mn, and S, by limiting the amounts of Fe, B, Si, and C to limited narrow ranges, strip improved in watt loss and with less variation in characteristics in the same lot can be stably obtained. According to this invention, an improvement in the yield can also be simultaneously realized.

Further, Japanese Patent Publication (A) No. 2001-279387 proposes a matrix alloy for producing rapidly cooled and solidified strip containing P, Mn, and S at the levels shown in Japanese Patent Publication (A) No. 09-95760 and containing as component elements, in addition to Fe, B, and Si, Ti, Zr, V, Nb, Cr, Mo, Co, Ni, and Cu, by atm %, 0.1 to 30%. According to this invention, utilization of a broader range of low grade iron sources is realized.

As explained above, use of a low grade iron source containing slight amounts of P, Mn, and S is made possible, so an inexpensive iron source can be used and the cost of the strip alloy can be reduced. Further, by optimizing the range of main elements in the ingredient system containing slight amounts of these impurities, achievement of a stable watt loss characteristic in a lot can be realized. However, there is a great need for improvement of the characteristics of Fe-based amorphous alloy strips. Further improvement of the watt loss is being demanded. In the inventions proposed in the previously mentioned Japanese Patent Publication (A) No. 09-202946 and Japanese Patent Publication (A) No. 2001-279387, the watt loss could for example be improved to 0.12 W/kg or less in terms of the watt loss $W_{13/50}$ (watt loss at flux density of 1.3 T and frequency of 50 Hz) measured by a single sheet, but it was extremely difficult to stably lower this to 0.10 W/kg or less.

DISCLOSURE OF THE INVENTION

To increase the flux density of an Fe—B—Si-based or Fe—B—Si—C-based amorphous alloy strip, reducing the amounts of ingredients other than Fe would be effective, but if doing this, there is the problem that the heat stability, amorphous phase forming ability, workability (brittleness), and watt loss are not improved. Further, in addition to this, further, an Fe-based amorphous alloy strip utilizing an inexpensive iron source and giving a stable watt loss could not be obtained up to now.

The inventors discovered that by including N in an Fe—B—Si-based or Fe—B—Si—C-based amorphous alloy, it is possible to make the impurity elements (Al etc.) said to be crystallization promoting elements concentrate at the surface oxide layer and thereby prevent crack propagation at the amorphous alloy strip and greatly improve the workability. The inclusion of this N eliminates the problem when introducing the P effective for improving the low watt loss and amorphous phase forming ability (the introduction of P makes it easier for cracks to propagate in the strip) and thereby enables the production of Fe-based amorphous alloy strip provided with a high flux density and superior in heat stability, amorphous phase forming ability, workability (brittleness), and watt loss.

Further, it was learned that introducing P and introducing N are effective for alleviating the problem of embrittlement of the strip caused when substituting part of the Fe with Ni, Co, and Cr for the purpose of improving the characteristics of the flux density and corrosion resistance and the annealing conditions etc.

Further, in addition, the inventors discovered that in a system of ingredients including the impurities of P, Mn, and S in amounts of levels entering from a low grade iron source, suitably prescribing the ingredients enables a greater reduction of the watt loss.

The inventors engaged in repeated studies based on these findings and thereby completed the present invention. Its gist is as follows:

(1) An Fe-based amorphous alloy strip characterized by containing, by atm %, B: 5 to 25%, Si: 1 to 30%, N: 0.001 to 0.2%, and a balance of Fe and unavoidable impurities.

(2) An Fe-based amorphous alloy strip as set forth in (1) characterized by further containing, by atm %, one or both of C: 0.003 to 10% and P: 0.001 to 0.2% and a balance of Fe and unavoidable impurities.

(3) An Fe-based amorphous alloy strip as set forth in (2) characterized in that, by atm %, B: 10 to 20%, Si: 1 to 10%, N: 0.001 to 0.2%, C: 0.02 to 2%, and P: 0.001 to 0.2%.

(4) An Fe-based amorphous alloy strip as set forth in (2) characterized in that, by atm %, B: 5 to 12%, Si: 1 to 5%, N: 0.001 to 0.2%, C: 1 to 10%, and P: 0.001 to 0.2%.

(5) An Fe-based amorphous alloy strip as set forth in (1) to (4) characterized in that, by atm %, 15% or less of the amount of Fe is substituted by one or more of Co, Ni, or 5% or less of Cr.

(6) An Fe-based amorphous alloy strip superior in soft magnetic properties under an alternating current as set forth in (5) characterized by containing, by atm %, B: 12 to 16%, Si: 2 to 7%, N: 0.001 to 0.2%, Fe: 80 to 82%, and at least one of Co and Ni: 0.01 to 1% and further containing, by mass %, P: 0.008 to 0.1 mass %, Mn: 0.15 to 0.5 mass %, and S: 0.004 to 0.05 mass %.

(7) An Fe-based amorphous alloy strip superior in soft magnetic properties under an alternating current as set forth in (6) characterized by further containing, by atm %, C: 0.003 to 2%.

According to the present invention, it becomes possible to provide an Fe-based amorphous alloy strip provided with a high flux density and improved in heat stability, amorphous phase forming ability, workability (brittleness), and watt loss. Further, in addition to this, according to the present invention, it is possible to provide an inexpensive Fe-based amorphous metal alloy strip superior in soft magnetic properties able to further improve the soft magnetic properties of the alloy strip while maintaining the use of a low grade iron source for the alloy strip, that is, while maintaining the reduction in the production cost. In particular, it is possible to stably reduce the watt loss $W_{13/50}$ measured by the single sheet method to a stable 0.10 W/kg or less.

BEST MODE FOR CARRYING OUT THE INVENTION

Below, the functions and suitable ranges of content of the main elements for stably reducing more the soft magnetic properties under an alternating current, in particular, the watt loss, in a lot will be explained.

First, the composition of ingredients and their ranges in the present invention will be explained. Note that the ranges of the composition of the ingredients are, unless specially designated, all atm %.

B is an element effective for improvement of the amorphous phase forming ability and heat stability. A suitable quantity is added in accordance with the requirements of the different characteristics. If B is less than 5%, the amorphous phase cannot be stably formed, while if over 25%, the rise in the melting point makes formation of an amorphous phase difficult. If emphasizing a low watt loss and heat stability, B is preferably 10 to 20%, while if emphasizing a high flux density, it is necessary to reduce the semimetal elements, so 5 to 12% is preferable.

Si is similarly an element effective for improvement of the amorphous phase forming ability and heat stability. A suitably quantity is added in accordance with the requirements of the different characteristics. If Si is less than 1%, the amorphous phase cannot be stably formed, while if over 30%, the effect of improvement of the heat stability becomes saturated. If emphasizing a low watt loss and heat stability, Si is preferably 1 to 10%, while if emphasizing a high flux density, it is necessary to reduce the semimetal elements, so the content is preferably made 1 to 5%.

Further, even when using an iron source in which impurities are contained, by optimizing the contents of the B and Si elements and then including Co or Ni, it is possible to further improve the watt loss value. For example, it is possible to make the watt loss $W_{13/50}$ measured for a single sheet a stable 0.10 W/kg or less. If Si is less than 2% and B is less than 12%, with the ingredient system of this case, an amorphous alloy can no longer be stably obtained, so it would become difficult to stably make the watt loss 0.10 W/kg or less. On the other hand, if making Si more than 7%, in the ingredient system in this case, it would no longer be possible to make the watt loss a stable 0.1 W/kg or less in terms of $W_{13/50}$. If making B more than 16 atm %, when using an iron source in which impurities are contained, the embrittlement progresses so this is no longer preferable and the material costs end up rising. Therefore, if using an iron source in which impurities are contained, Si is preferably made 2 atm % to 7 atm % and B 12 atm % to 16 atm % in range.

N is an element effective for improvement of the heat stability, amorphous phase forming ability, and workability (brittleness) of amorphous strip. The suitable content is determined in accordance with the requirements of the different characteristics. If N is less than 0.001%, no improvement of these characteristics can be seen. On the other hand, if over 0.2%, the heat stability effect is saturated. N is preferably contained in an amount of 0.003%, 0.004%, 0.006%, 0.007%, 0.008%, 0.009%, or so or further 0.02%, 0.03%, 0.04%, 0.05%, or so. On the other hand, addition of N over 0.1% results in swelling costs. Preferably, the content is 0.09%, 0.08%, 0.07%, 0.06%, or so. If so, the cost of addition falls.

Note that when using an iron source in which impurities are contained and including Co or Ni, Cr, if aiming mainly at the effect of reducing the watt loss, N does not necessarily have to be added. It may just be contained as an unavoidable impurity.

C is an element effective for improving the flux density of strip and improving the amorphous phase forming ability (improving the castability). A suitable content is determined in accordance with the requirements of the different characteristics. By including C in an amount of 0.001% or more, preferably 0.003% or more, the wettability of the melt and cooling substrate is improved and a good strip can be formed. Further, if C is 0.01% or more, preferably 0.02% or more, an effect of improvement of the amorphous phase forming ability is obtained. More preferably, 0.03%, 0.06%, 0.08%, 0.1%, 0.15%, 0.2%, 0.3%, 0.5%, 0.6%, 0.7%, 0.8%, 0.9%, and further 1%, 2%, 3%, 4%, and 5% can be included. On the other hand, if over 10%, the effect of improvement of the flux density falls. If emphasizing a low watt loss and heat stability, C is preferably 0.02 to 2%, while if emphasizing a high flux density, the amount of B is reduced, so the melting point rises, and therefore the semimetal element C is preferably added in an amount of 1 to 10%.

Note that when using an iron source in which impurities are contained, when including Co or Ni, Cr, if C is included in an amount greater than 2 atm %, this effect soon cannot be recognized. When Co or Ni, Cr is included, if adjusting the content of B or Si, C need not be included, but when including C, C should be made 0.003 atm % to 2 atm %.

P is an element effective for improvement of the watt loss and amorphous phase forming performance. A suitable quantity is contained in accordance with the requirements of the different characteristics. With the inclusion of P, the amorphous phase forming performance is improved and the allowable amount of content of impurity elements is increased, but if P is less than 0.001%, no effect of improvement of the amorphous phase forming performance can be seen and no effect of improvement of the watt loss can be seen either. By including P, the amorphous phase forming ability is improved. On the other hand, along with the increase in the content of P, there are the problems that cracks easily propagate in the strip and the workability deteriorates. Further, if P is over 0.2%, the bending fracture diameter when bending and breaking the amorphous strip with the roll cooled surface at the outside becomes greater and the workability (brittleness) of the amorphous strip deteriorates. P may be contained in amounts of 0.002%, 0.003%, 0.004%, 0.006%, 0.008%, 0.01%, 0.02%, 0.03%, 0.04%, 0.05%, 0.06%, 0.07%, 0.08%, and also 0.12% or 0.15% or so.

In particular, if making P a range of 0.008 mass % to 0.1 mass % or less, even if using the above-mentioned inexpensive iron source, the watt loss can be stably lowered. On the other hand, in this case, if the content of P is less than 0.008 mass %, the effect of increasing the allowable amounts of the impurity elements Mn and S will no longer appear.

In the present invention, if substituting 15% or less of the amount of Fe by one or more of Co, Ni, or 5% or less of Cr, the problem of embrittlement of the amorphous strip will not arise and a good amorphous strip will be obtained. These elements may preferably be included in amounts of 0.001%, 0.002%, 0.003%, 0.005%, 0.008%, 0.01%, 0.02%, 0.03%, 0.04%, 0.05%, 0.06%, 0.07%, 0.08%, 0.1%, 0.2%, 0.3%, 0.4%, 0.5%, 0.6%, or so. However, for Co and Ni, while there was an effect of improvement of the flux density, these are expensive, so if considering the cost of the materials, they are preferably kept to substitution of 10% or less, more preferably 5% or less, of the amount of Fe. These elements may more preferably be 4%, 3%, 2%, 1%, or less.

The content of Fe, usually if 70% or more, gives a practical level of saturated flux density as an iron core, but to obtain a high saturated flux density of 1.6 T or more, Fe is preferably made over 80 atm %. On the other hand, if the content of Fe becomes over 86%, formation of an amorphous phase becomes difficult. To stably obtain an amorphous state, the Fe content should be made 82% or less.

Below, the case of use of an inexpensive iron source will be explained.

When using an inexpensive iron source, at least one type of Co, Ni, and Cr may be included in an amount of 0.01% to 1%, whereby a further improvement of the watt loss can be realized and the watt loss can be stably made 0.10 W/kg or less at $W_{13/50}$. The inclusion of Co also leads to improvement of the flux density. However, if less than 0.01%, this effect soon can no longer be obtained. On the other hand, if 1% or more, when an iron source in which impurities are contained to a certain extent is used, this effect is no longer recognized and conversely the material cost ends up becoming higher. Therefore, at least one type of Co, Ni, and Cr was made 0.01% to 1%. Note that the preferable ranges of Co, Ni, and Cr in this case were 0.05% to 1%.

The contents of Mn and S in the case of using an inexpensive iron source will be explained next. When the Mn exceeds 0.5 mass % and the S exceeds 0.05 mass %, even if including P in an amount of 0.008 mass % to 0.1 mass %, no improvement of the watt loss of the strip is obtained. On the other hand, if making Mn less than 0.15 mass %, when making S less than 0.004 mass %, it no longer becomes possible to use an inexpensive iron source and an expensive high purity iron source like in the past has to be used. As a result, the alloy cost increases—which is not preferable. Further, the contents of the Mn and S impurity elements are preferably as small as possible in the ranges limited in the present invention. Mn is preferably made 0.15 mass % to 0.3 mass %, and S is preferably made 0.004 mass % to 0.02 mass %.

In this case, when determining the ingredients of the strip of the present invention, first the contents of Fe, Co, Ni, B, Si, and C are determined in atm %, then the ingredients of the inexpensive iron source including these impurities are determined so that P, Mn, and S fall in the ranges of the present invention. The alloy composition will be explained specifically by examples.

When using an inexpensive iron source, for example, part of the steel produced by the steelmaking process using iron ore as a material may be used for the iron source of the alloy, but the iron source for producing the strip of the present invention is not limited to the type of steel produced by this steelmaking process. Further, the trace ingredients included in the present invention may be deliberately added by alloys etc. or may be introduced by making deliberate use of the impurity ingredients entering from other alloys etc.

Further, the present invention may include, as component elements, the known Ti, Zr, V, Nb, Mo, Cu, etc. in addition to Fe, B, and Si. The effect of the present invention is not impaired in any way. In particular, Ti and Zr are known to be effective in improving the amorphous phase forming ability. These may be included in amounts of 0.01 to 5% or so.

The strip of the present invention can be produced by melting the alloy ingredients of the present invention and ejecting the melt through a slot nozzle etc. on to a cooling plate moving at a high speed, and rapidly cooling and solidifying the melt, for example, the single roll method or the twin roll method. The single roll apparatus is provided with a centrifugal rapid cooling apparatus using the inside wall of a drum, an apparatus using an endless type belt, improved version auxiliary rolls and roll surface temperature control apparatus, and a casting apparatus under reduced pressure or in vacuum or in inert gas. In the present invention, the plate thickness, plate width, or other dimensions of the strip are not particularly limited, but the plate thickness of strip is preferably for example 10 μm to 100 μm. Further, the plate width is preferably 20 mm or more.

EXAMPLES

Example 1

A single roll amorphous alloy strip production system comprised of a copper alloy cooling roll of a diameter of 580 mm (roll speed 800 rpm), a high frequency induction melting apparatus for melting the samples, a quartz glass crucible, a slit nozzle of a length of 25 mm and a width of 0.6 mm provided at the front end of the crucible was used with the ingredients shown in Table 1 comprised of the Fe—B—Si-based composition into which N and C and P were added so as to produce an amorphous alloy strip of a width of 25 mm and a thickness of 28 to 35 μm. Note that as the Fe source, converter steel with only small impurities was used. B was added as Fe—B, Si was added as Fe—Si, C was added as pure C, P was added as Fe—P, and N was added by mixing iron nitride in the nitrogen gas stream. Table 1 shows the compositions of ingredients and the obtained characteristics. Note that the characteristics of the obtained amorphous alloy strip were measured by the methods explained below.

1) For the magnetic characteristics, the obtained strip was annealed at 360° C. for 1 hour in a nitrogen atmosphere and a magnetic field and measured by a single sheet tester (SST). The watt loss at a flux density of 1.3 T and frequency of 50 Hz and the flux density ($B_8$) at a magnetic field of 800 A/m were used for evaluation.

2) For the heat stability, the Curie temperature was as an evaluation indicator for evaluation (the larger the Curie temperature, the stabler thermally) by a vibrating sample magnetometer (VSM).

3) For the amorphous phase forming ability, the crystallization temperature (Tp) and the melting point (Tm) were measured by a differential scan calorimeter (DSC) as evaluation indicators and indicated as Tp/Tm (the larger the Tp/Tm, the better the amorphous phase forming ability).

4) For evaluation of the brittleness, the amorphous strip after annealing at 360° C. for 1 hour in a nitrogen atmosphere was bent with the roll cooled surface of the strip at the outside and the bending fracture diameter at the time of fracture was measured (the larger the bending fracture diameter, the worse the brittleness).

When using the amorphous strip for the iron cores of power transformers, high frequency transformers, etc., since amorphous strip is extremely thin, it is usually used as a wound iron core. Therefore, when producing iron core, the brittleness in particular becomes an important characteristic. The inventors investigated this and as a result found that the bending fracture diameter used as an indicator for evaluation of brittleness has to be 4 mm or less. Further, from the annealing temperature or other production conditions, design conditions, etc., it was learned that Tp/Tm has to be 0.5 or more and the Curie temperature has to be 350° C. or more. On the other hand, the watt loss and flux density are selected in accordance with need since they relate to the design of the iron core. (In general, a low watt loss and high flux density are demanded, but they may be selected in accordance with the equipment covered, for example, by a design where a high flux density is given priority even if the watt loss is somewhat high, a design where the low watt loss is important and the flux density is not stressed that much).

TABLE 1

| Sample No. | | Fe | B | Si | C | P | N | Watt loss (W/kg) | Flux density B8 (T) | Curie temperature (° C.) | Tp/Tm (-) | Bending fracture diameter (mm) | Remarks |
|---|---|---|---|---|---|---|---|---|---|---|---|---|---|
| Inv. ex. | 1 | 82.99 | 15 | 2 | 0.001 | 0.0008 | 0.004 | 0.151 | 1.58 | 372 | 0.48 | 3.7 | N added |
| | 2 | 82.07 | 15 | 2 | 0.93 | 0.0006 | 0.004 | 0.145 | 1.64 | 377 | 0.50 | 3.6 | N, C added |
| | 3 | 82.90 | 15 | 2 | 0.001 | 0.1 | 0.004 | 0.122 | 1.58 | 377 | 0.50 | 3.6 | N, P added |
| | 4 | 81.97 | 15 | 2 | 0.93 | 0.1 | 0.004 | 0.116 | 1.64 | 376 | 0.51 | 3.1 | N, C, P added |
| | 5 | 81.87 | 15 | 2 | 0.93 | 0.2 | 0.004 | 0.106 | 1.63 | 376 | 0.54 | 3.5 | P increased |
| | 6 | 81.96 | 15 | 2 | 0.93 | 0.1 | 0.01 | 0.112 | 1.65 | 381 | 0.53 | 2.7 | N increased |
| | 7 | 81.87 | 15 | 2 | 0.93 | 0.1 | 0.1 | 0.112 | 1.64 | 388 | 0.54 | 2.7 | N increased |
| | 8 | 81.77 | 15 | 2 | 0.93 | 0.1 | 0.2 | 0.113 | 1.64 | 398 | 0.56 | 2.6 | N increased |
| Comp. ex. | 1 | 83.00 | 15 | 2 | 0.001 | 0.0008 | 0.0007 | 0.172 | 1.58 | 361 | 0.45 | 5.3 | N, C, P not added |
| | 2 | 81.82 | 15 | 2 | 0.93 | 0.25 | 0.004 | 0.115 | 1.59 | 376 | 0.53 | 4.9 | P excessively added |
| | 3 | 81.72 | 15 | 2 | 0.93 | 0.1 | 0.25 | 0.118 | 1.61 | 395 | 0.56 | 2.6 | N excessively added |

Table 1 shows the composition of ingredients of the invention examples and comparative examples for giving a low watt loss and high flux density and the results of their evaluation of the same relating to the aspects of the invention of claims 1 and 2 of the present invention. In Table 1, Comparative Example 1 is an Fe—B—Si-based amorphous strip not containing any of N, C, or P and is the base composition of ingredients. The magnetic characteristics, heat stability, amorphous phase forming ability, and brittleness of amorphous strips obtained by including N, C, and P were evaluated compared with Comparative Example 1.

Invention Example 1 corresponds to Comparative Example 1 but includes N in an amount of 0.004% and is improved in the heat stability, amorphous phase forming ability, and brittleness. Invention Example 2 includes C in an amount of 0.93% and includes N in an amount of 0.004%, so is improved in flux density as well. On the other hand, Invention Example 3 includes P in an amount of 0.1% and includes N in an amount of 0.004%, so becomes good in watt loss. Invention Example 4 includes C in an amount of 0.93%, P in 0.1%, and N in 0.004% and is improved in all of the heat stability, amorphous phase forming ability, brittleness, flux density, and watt loss. In Invention Example 5, C and N are the same as in Invention Example 4, but P is included in an amount of 0.2. Due to the reduction in the Fe, the flux density slightly fell, but the watt loss value was greatly improved. Further, the amorphous phase forming ability and brittleness were also improved. On the other hand, in Comparative Example 2, P is contained in an excess 0.25%, so the flux density fell and the brittleness worsened. Invention Examples 6 to 8 include C in an amount of 0.93% and P in 0.1% and are changed in content of N, but are not greatly changed in flux density and watt loss and are improved in heat stability, amorphous phase forming ability, and brittleness along with the increase in the content of the amount of N. Comparative Example 3 contains N in an excess 0.25%. The cost of addition of N swells, but the heat stability and amorphous phase forming ability are already saturated. Further, due to the increase of N, the flux density falls.

From the above, it is learned that the heat stability, amorphous phase forming ability, workability (brittleness), and watt loss are improved.

Example 2

The same method as in Example 1 and the ingredients shown in Table 2 were used to produce amorphous alloy strips comprised of Fe—B—Si—C—P—N-based amorphous alloy strips of widths of 25 mm and thicknesses of 28 to 35 μm. Table 2 shows the compositions of ingredients and the obtained characteristics. Note that the measurement methods and evaluation methods were the same as in Example 1.

TABLE 2

| Sample No. | | Fe | B | Si | C | P | N | Watt loss (W/kg) | Flux density B8 (T) | Curie temperature (° C.) | Tp/Tm (-) | Bending fracture diameter (mm) | Remarks |
|---|---|---|---|---|---|---|---|---|---|---|---|---|---|
| Inv. ex. | 9 | 80.52 | 12 | 6.5 | 0.97 | 0.005 | 0.004 | 0.12 | 1.59 | 385 | 0.57 | 3.3 | P increased |
| | 10 | 80.43 | 12 | 6.5 | 0.97 | 0.1 | 0.004 | 0.104 | 1.58 | 386 | 0.59 | 2.3 | P increased |
| | 11 | 80.33 | 12 | 6.5 | 0.97 | 0.2 | 0.004 | 0.093 | 1.57 | 385 | 0.62 | 2.9 | P increased |
| | 12 | 80.42 | 12 | 6.5 | 0.97 | 0.1 | 0.01 | 0.102 | 1.59 | 392 | 0.61 | 1.9 | N increased |
| | 13 | 80.33 | 12 | 6.5 | 0.97 | 0.1 | 0.1 | 0.103 | 1.58 | 395 | 0.62 | 1.8 | N increased |
| | 14 | 80.23 | 12 | 6.5 | 0.97 | 0.1 | 0.2 | 0.103 | 1.58 | 398 | 0.62 | 1.7 | N increased |
| Comp. ex. | 4 | 80.53 | 12 | 6.5 | 0.97 | 0.0007 | 0.0008 | 0.127 | 1.59 | 382 | 0.55 | 4.2 | N, P not added |
| | 5 | 80.28 | 12 | 6.5 | 0.97 | 0.25 | 0.004 | 0.107 | 1.54 | 385 | 0.62 | 4.4 | P excessively added |
| | 6 | 80.18 | 12 | 6.5 | 0.97 | 0.1 | 0.25 | 0.117 | 1.55 | 397 | 0.61 | 1.7 | N excessively added |

Table 2 shows the compositions of ingredients of the invention examples and comparative examples low in watt loss, good in workability, and giving a medium degree of flux density and the results of their evaluation relating to the aspect of the invention of claim 3 of the present invention. In Table 2, Comparative Example 4 does not contain either P and N and is the base composition of ingredients. The magnetic characteristics, heat stability, amorphous phase forming ability, and brittleness of amorphous strips obtained by including P and N compared with Comparative Example 4 were evaluated.

In the Invention Example 9, P is contained in an amount of 0.005% and N in 0.004% and an improvement in the watt loss, brittleness, and heat stability was seen. Invention Examples 10 and 11 contained P: 0.1%, P: 0.2%, and N: 0.004% and were reduced in Fe, but the flux density dropped slightly, so the watt loss value was greatly improved. Further, the amorphous phase forming ability and brittleness were also improved. On the other hand, in Comparative Example 5, P is added in an excessive 0.25%, so the flux density dropped and the strip became brittle. Invention Examples 12 to 14 exhibited low watt loss due to the addition of P: 0.1% and were improved in amorphous phase forming ability as well, but along with the increase in content of N, the heat stability, amorphous phase forming ability, and brittleness were improved. Comparative Example 6 contains N in an excess 0.25%, so the cost of addition of N swelled, the heat stability and amorphous phase forming ability already became saturated, and the flux density dropped due to the increase in N.

From the above, it was learned that in the compositions of ingredients of Table 2 as well, the heat stability, amorphous phase forming ability, workability (brittleness), and watt loss were improved.

Example 3

The same method as in Example 1 and the ingredients shown in Table 3 were used to produce Fe—B—Si—C—P—N-based amorphous alloy strips of widths of 25 mm and thicknesses of 28 to 35 μm. Table 3 shows the compositions of ingredients and the obtained characteristics. Note that the measurement methods and evaluation methods were the same as in Example 1.

density relating to the aspect of the invention of claim 4 of the present invention. In Table 3, Comparative Example 7 does not contain either P and N and is the base composition of ingredients. The magnetic characteristics, heat stability, amorphous phase forming ability, and brittleness of amorphous strips obtained by including P and N compared with Comparative Example 7 were evaluated.

In the Invention Example 15, P is contained in an amount of 0.005% and N in 0.004% and an improvement in the watt loss, brittleness, and heat stability was seen. Invention Examples 16 and 17 contained P: 0.1%, P: 0.2%, and N: 0.004% and were reduced in Fe, but the flux density dropped slightly, so the watt loss value was greatly improved. Further, the amorphous phase forming ability and brittleness were also improved. On the other hand, in Comparative Example 8, P is added in an excessive 0.25%, so the flux density dropped and the strip became brittle. Invention Examples 18 to 20 exhibited low watt loss due to the addition of P: 0.1% and were improved in amorphous phase forming ability as well, but along with the increase in content of N, the heat stability, amorphous phase forming ability, and brittleness were improved. Comparative Example 9 contains N in an excessive 0.25%, so the cost of addition of N swelled, the heat stability and amorphous phase forming ability already became saturated, and the flux density dropped due to the increase in N.

From the above, it was learned that in the compositions of ingredients of Table 3 as well, the heat stability, amorphous phase forming ability, workability (brittleness), and watt loss were improved.

Example 4

The same method as in Example 1 and the ingredients shown in Table 4 were used to produce amorphous alloy strips comprised of Fe—B—Si—C—P—N-based amorphous alloy strips of widths of 25 mm and thicknesses of 28 to 35 μm in which the Fe was substituted by Co, Ni, and Cr. Table 4 shows the compositions of the ingredients and the obtained characteristics. Note that the measurement methods and evaluation methods were the same as Example 1.

TABLE 3

| Sample No. | | Fe | B | Si | C | P | N | Watt loss (W/kg) | Flux density B8 (T) | Curie temperature (° C.) | Tp/Tm (-) | Bending fracture diameter (mm) | Remarks |
|---|---|---|---|---|---|---|---|---|---|---|---|---|---|
| Inv. | 15 | 85.99 | 7 | 1 | 6 | 0.005 | 0.004 | 0.227 | 1.71 | 352 | 0.51 | 3.8 | P increased |
| ex. | 16 | 85.90 | 7 | 1 | 6 | 0.1 | 0.004 | 0.189 | 1.70 | 352 | 0.51 | 3.6 | P increased |
| | 17 | 85.80 | 7 | 1 | 6 | 0.2 | 0.004 | 0.157 | 1.69 | 351 | 0.52 | 3.9 | P increased |
| | 18 | 85.89 | 7 | 1 | 6 | 0.1 | 0.01 | 0.182 | 1.70 | 364 | 0.53 | 3.5 | N increased |
| | 19 | 85.80 | 7 | 1 | 6 | 0.1 | 0.1 | 0.173 | 1.69 | 368 | 0.54 | 3.4 | N increased |
| | 20 | 85.70 | 7 | 1 | 6 | 0.1 | 0.2 | 0.177 | 1.69 | 376 | 0.55 | 3.1 | N increased |
| Comp. | 7 | 86.00 | 7 | 1 | 6 | 0.0007 | 0.0007 | 0.252 | 1.71 | 345 | 0.46 | 5.1 | N, P not added |
| ex. | 8 | 85.75 | 7 | 1 | 6 | 0.25 | 0.004 | 0.189 | 1.65 | 350 | 0.55 | 5.0 | P excessively added |
| | 9 | 85.65 | 7 | 1 | 6 | 0.1 | 0.25 | 0.185 | 1.64 | 374 | 0.54 | 3.0 | N excessively added |

Table 3 shows the compositions of ingredients of the invention examples and comparative examples giving a high flux

TABLE 4

| | Sample No. | Fe | B | Si | C | P | N | Co | Ni | Cr | Watt loss (W/kg) | Flux density B8 (T) | Curie temperature (° C.) | Tp/Tm (-) | Bending fracture diameter (mm) | Remarks |
|---|---|---|---|---|---|---|---|---|---|---|---|---|---|---|---|---|
| Inv. ex. | 21 | 79.41 | 12 | 6.5 | 0.001 | 0.0007 | 0.01 | 2 | 0.03 | 0.05 | 0.135 | 1.75 | 379 | 0.51 | 3.8 | Flux density improved (C, P not added |
| | 22 | 79.31 | 12 | 6.5 | 0.001 | 0.1 | 0.01 | 2 | 0.03 | 0.05 | 0.120 | 1.75 | 384 | 0.52 | 3.7 | Flux density improved (C not added) |
| | 23 | 78.44 | 12 | 6.5 | 0.97 | 0.0007 | 0.01 | 2 | 0.03 | 0.05 | 0.134 | 1.78 | 391 | 0.52 | 3.7 | Flux density improved (P not added) |
| | 24 | 78.34 | 12 | 6.5 | 0.97 | 0.1 | 0.01 | 2 | 0.03 | 0.05 | 0.118 | 1.79 | 391 | 0.52 | 3.7 | Flux density improved |
| | 25 | 77.37 | 12 | 6.5 | 0.97 | 0.1 | 0.01 | — | 3 | 0.05 | 0.125 | 1.74 | 374 | 0.51 | 3.5 | Flux density improved |
| | 26 | 78.39 | 12 | 6.5 | 0.97 | 0.1 | 0.01 | — | 0.03 | 2 | 0.127 | 1.55 | 353 | 0.56 | 3.9 | Corrosion resistance improved |
| | 27 | 74.42 | 12 | 6.5 | 0.97 | 0.1 | 0.01 | 1 | 3 | 2 | 0.122 | 1.73 | 371 | 0.53 | 3.8 | Flux density/ corrosion resistance improved |
| Co. ex. | 10 | 79.42 | 12 | 6.5 | 0.001 | 0.0007 | 0.0008 | 2 | 0.03 | 0.05 | 0.137 | 1.75 | 374 | 0.48 | 5.6 | N, C, P not added |
| | 11 | 79.32 | 12 | 6.5 | 0.001 | 0.1 | 0.0007 | 2 | 0.03 | 0.05 | 0.118 | 1.75 | 378 | 0.50 | 5.5 | N, C not added |
| | 12 | 78.45 | 12 | 6.5 | 0.97 | 0.0008 | 0.0008 | 2 | 0.03 | 0.05 | 0.127 | 1.78 | 385 | 0.51 | 5.4 | N, P not added |
| | 13 | 77.48 | 12 | 6.5 | 0.97 | 0.0007 | 0.0007 | — | 3 | 0.05 | 0.133 | 1.75 | 371 | 0.49 | 5.2 | N, P not added |
| | 14 | 78.50 | 12 | 6.5 | 0.97 | 0.0007 | 0.0008 | — | 0.03 | 2 | 0.139 | 1.55 | 349 | 0.55 | 5.9 | N, P not added |
| | 15 | 74.53 | 12 | 6.5 | 0.97 | 0.0007 | 0.0008 | 1 | 3 | 2 | 0.132 | 1.74 | 368 | 0.52 | 5.9 | N, P not added |

Table 4 shows the compositions of ingredients of the invention examples and comparative examples designed for improving the flux density and corrosion resistance relating to the aspect of the invention of claim 5 of the present invention. In Table 4, Invention Examples 21 to 24 substitute Fe with Co to improve the flux density, while Invention Example 25 substitutes it with Ni. Further, Invention Example 21 is a composition not containing C and P, Invention Example 22 not containing C, and Invention Example 23 not containing P. Invention Example 26 substitutes Fe with Cr for the purpose of improving the corrosion resistance. Invention Example 27 substitutes Fe with Co, Ni, and Cr for the purpose of improvement of both of the flux density and corrosion resistance. Note that Ni and Cr unavoidably enter in fine amounts from the Fe source and Fe—B and other added alloys (for example, Table 4, Invention Example 21, Ni: 0.03% and Cr: 0.05%). Comparative Examples 10 and 11 are examples corresponding to Invention Examples 21 and 22 but not containing N, while Comparative Example 12 is an example corresponding to Invention Example 23 but not containing N and Invention Example 24 but not containing N and P.

Further, Comparative Examples 12 to 14 are examples corresponding to Invention Examples 24 to 27 but not containing N and P.

In the invention examples, it will be understood that in each case the bending fracture diameter decreased by about 40% and became 4 mm or less due to the effect of inclusion of N and that the brittleness was improved. Further, the watt loss also became good due to the effect of P. The brittleness due to the addition of P was also improved due to the effect of inclusion of N.

From the above, it is learned that even when substituting Fe by Co, Ni, and Cr, the strip characteristics are improved by the effect of inclusion of P and N.

Example 5

Fe—(Co, Ni)B—Si—(C) alloys containing P in 0.018 mass %, Mn in 0.21 mass %, and S in 0.006 mass % were melted in an argon atmosphere and cast by the single roll method into a strip. The casting atmosphere was made the air. At this time, as shown in Table 5, the inventors changed the ratios of contents of Fe, Co, Ni, B, Si, and C to investigate the relationship between the ratios of contents of these elements and the strip characteristics. The ratios of Fe, Co, Ni, B, Si, and C are shown as Fe+Co+Ni+B+Si+C=100 atm %. The single roll strip production system used was the same as Example 1, but in this experiment, a slot nozzle of a length of 25 mm and a width of 0.4 mm was used. As a result, the plate thicknesses of the obtained strips were about 25 μm, while the plate widths, which are dependent on the length of the slot nozzle, were 25 mm.

The watt losses of the strips were measured using a SST (single sheet tester). The measurement conditions were a flux density of 1.3 T and a frequency of 50 Hz. For the measurement samples of watt loss, strip samples cut over the overall length of one lot from 12 locations in 120 mm lengths were used. These strip samples were annealed at 360° C. for 1 hour in a magnetic field and used for measurement. The atmosphere during the annealing was made nitrogen.

As the results of measurement of the watt losses, the values of the maximum value (Wmax) and minimum value (Wmin) in one lot and the deviation ((Wmax−Wmin)/Wmin) are shown in Table 5.

As clear from the results of Sample Nos. 1 to 32 of Table 5, it was learned that in the range of the present invention where Fe is over 80% to 82%, at least one of Co and Ni is 0.01% to 1%, B is 12% to 16%, Si is 2% to 7%, and C is 2% or less, by including P, Mn, and S in the range of the present invention, a strip is obtained having a watt loss at a flux density of 1.3 T and a frequency of 50 Hz of less than 0.1 W/kg, having an error ((Wmax−Wmin)/Wmin) of less than 0.1, and superior in soft magnetic properties across the overall length of the strip is obtained.

As opposed to this, in the range of ingredients of the comparative examples shown in Sample Nos. 33 to 48, there are portions where the watt loss becomes larger than 0.11 W/kg and the error ((Wmax−Wmin)/Wmin) ends up becoming 0.1 or more. Further, in Sample Nos. 36 to 38, the alloy costs became higher, while in Sample Nos. 42 and 43, the embrittlement of the strips became greater.

From the above, it was learned that according to the present invention, further improvement of the soft magnetic properties can be realized.

Example 6

Alloys comprised of the main constituent elements Fe, Co, Ni, B, Si, and C in compositions giving, by atm %, $Fe_{80.3}Co_{0.12}Ni_{0.14}B_{13.5}Si_{5.2}C_{0.74}$, and containing P, Mn, and S in various ratios were cast into strips by apparatuses and conditions similar to Example 5. As a result, the plate thicknesses of the obtained strips were about 25 μm. The watt losses of the obtained strips were evaluated. The method of obtaining the measurement samples and the measurement conditions for evaluation of the watt losses were the same as in Example 5. The results of measurement are shown in Table 6. Note that the manner of expression of the items shown in Table 6 is similar to the case of Table 5.

As clear from the results of Sample Nos. 1 to 17 of Table 6, it was learned that when in the range of the present invention

TABLE 5

| Sample | | Chemical composition (atm %) | | | | | | Watt loss value (W/kg) | | |
|---|---|---|---|---|---|---|---|---|---|---|
| | No. | Fe | Co | Ni | B | Si | C | Wmax | Wmin | Error |
| Inv. | 1 | 80.1 | 0.10 | — | 13.8 | 4.8 | 1.2 | 0.095 | 0.087 | 0.09 |
| ex. | 2 | 80.38 | — | 0.12 | 13.9 | 4.6 | 1.0 | 0.099 | 0.091 | 0.09 |
| | 3 | 80.21 | 0.13 | 0.26 | 13.8 | 5.0 | 0.6 | 0.096 | 0.092 | 0.04 |
| | 4 | 80.05 | 0.27 | 0.68 | 16.0 | 3.0 | — | 0.093 | 0.086 | 0.08 |
| | 5 | 80.19 | 0.05 | — | 12.7 | 6.4 | 0.66 | 0.098 | 0.090 | 0.09 |
| | 6 | 80.62 | — | 0.06 | 13.3 | 5.1 | 0.92 | 0.099 | 0.091 | 0.09 |
| | 7 | 81.8 | — | 0.10 | 14.1 | 2.0 | 2.0 | 0.099 | 0.091 | 0.09 |
| | 8 | 82.0 | — | 0.23 | 14.9 | 2.8 | 0.07 | 0.098 | 0.090 | 0.09 |
| | 9 | 80.2 | 0.8 | — | 12.8 | 5.8 | 0.4 | 0.094 | 0.088 | 0.07 |
| | 10 | 80.6 | 0.51 | — | 15.8 | 2.5 | 0.59 | 0.096 | 0.089 | 0.08 |
| | 11 | 80.8 | 0.42 | — | 15.3 | 2.3 | 1.18 | 0.096 | 0.090 | 0.07 |
| | 12 | 81.0 | 0.21 | — | 13.3 | 4.7 | 0.79 | 0.093 | 0.085 | 0.09 |
| | 13 | 80.4 | 0.16 | — | 12.3 | 7.0 | 0.14 | 0.095 | 0.088 | 0.08 |
| | 14 | 80.9 | 0.08 | 0.32 | 15.1 | 3.4 | 0.2 | 0.099 | 0.091 | 0.09 |
| | 15 | 80.5 | 0.25 | 0.47 | 15.2 | 3.1 | 0.48 | 0.094 | 0.088 | 0.07 |
| | 16 | 80.4 | 0.34 | 0.55 | 14.8 | 3.6 | 0.31 | 0.096 | 0.089 | 0.08 |
| | 17 | 80.2 | 0.18 | 0.79 | 12.5 | 4.5 | 1.83 | 0.099 | 0.091 | 0.09 |
| | 18 | 80.3 | 0.06 | 0.94 | 12.9 | 4.2 | 1.6 | 0.098 | 0.092 | 0.06 |
| | 19 | 80.5 | — | 0.98 | 14.5 | 4.0 | 0.02 | 0.099 | 0.092 | 0.08 |
| | 20 | 80.4 | — | 0.89 | 13.7 | 4.9 | 0.11 | 0.097 | 0.090 | 0.08 |
| | 21 | 81.21 | — | 0.09 | 13.0 | 5.7 | — | 0.098 | 0.091 | 0.08 |
| | 22 | 81.5 | 0.09 | — | 13.8 | 3.8 | 0.81 | 0.098 | 0.091 | 0.08 |
| | 23 | 81.4 | 0.12 | 0.15 | 12.0 | 6.2 | 0.13 | 0.099 | 0.092 | 0.08 |
| | 24 | 81.7 | 0.21 | 0.2 | 12.1 | 5.5 | 0.29 | 0.098 | 0.093 | 0.05 |
| | 25 | 80.7 | 0.32 | 0.08 | 12.3 | 6.6 | — | 0.096 | 0.090 | 0.07 |
| | 26 | 80.1 | 0.73 | — | 12.2 | 6.8 | 0.17 | 0.094 | 0.087 | 0.08 |
| | 27 | 80.1 | 0.96 | — | 15.6 | 2.6 | 0.74 | 0.098 | 0.091 | 0.08 |
| | 28 | 80.46 | 0.04 | — | 15.5 | 4.0 | — | 0.097 | 0.091 | 0.06 |
| | 29 | 80.25 | — | 0.047 | 15.5 | 4.2 | 0.003 | 0.098 | 0.092 | 0.06 |
| | 30 | 80.2 | 0.01 | 0.01 | 15.1 | 4.6 | 0.08 | 0.097 | 0.091 | 0.06 |
| | 31 | 80.09 | — | 0.01 | 15.1 | 4.8 | — | 0.098 | 0.090 | 0.09 |
| | 32 | 80.2 | 0.01 | — | 15.2 | 4.5 | 0.09 | 0.098 | 0.092 | 0.06 |
| Comp. | 33 | 78.5 | 0.02 | 0.01 | 15.5 | 4.2 | 1.77 | 0.120 | 0.101 | 0.19 |
| ex. | 34 | 79.6 | — | 0.04 | 14.6 | 4.5 | 1.26 | 0.118 | 0.102 | 0.16 |
| | 35 | 82.3 | 0.16 | 0.15 | 15.1 | 2.2 | 0.09 | 0.129 | 0.110 | 0.17 |
| | 36 | 80.7 | 0.54 | 0.53 | 13.0 | 4.1 | 1.13 | 0.114 | 0.101 | 0.13 |
| | 37 | 80.6 | 1.06 | — | 13.8 | 4.3 | 0.24 | 0.115 | 0.102 | 0.13 |
| | 38 | 80.5 | — | 1.05 | 13.6 | 4.6 | 0.25 | 0.123 | 0.108 | 0.14 |
| | 39 | 80.2 | 0.24 | 0.11 | 12.1 | 7.2 | 0.15 | 0.121 | 0.106 | 0.14 |
| | 40 | 80.7 | 0.13 | 0.21 | 15.8 | 1.8 | 1.36 | 0.124 | 0.108 | 0.15 |
| | 41 | 80.8 | 0.41 | — | 11.8 | 5.4 | 1.59 | 0.128 | 0.112 | 0.14 |
| | 42 | 80.2 | — | 0.24 | 16.3 | 1.9 | 1.36 | 0.131 | 0.114 | 0.15 |
| | 43 | 80.8 | 0.09 | 0.11 | 16.1 | 2.8 | 0.10 | 0.129 | 0.113 | 0.14 |
| | 44 | 81.1 | 0.12 | 0.10 | 12.3 | 4.2 | 2.18 | 0.119 | 0.101 | 0.18 |
| | 45 | 80.3 | 0.16 | — | 12.1 | 4.0 | 3.44 | 0.119 | 0.102 | 0.17 |
| | 46 | 80.202 | 0.008 | — | 15.2 | 4.2 | 0.39 | 0.112 | 0.101 | 0.11 |
| | 47 | 80.303 | — | 0.007 | 15.1 | 4.5 | 0.09 | 0.113 | 0.102 | 0.11 |
| | 48 | 80.202 | 0.004 | 0.004 | 15.6 | 3.9 | 0.29 | 0.112 | 0.101 | 0.11 |

where P is 0.008 mass % to 0.1 mass %, Mn is 0.15 mass % to 0.5 mass %, and S is 0.004 mass % to 0.05 mass %, a strip having a watt loss at a flux density of 1.3 T and a frequency of 50 Hz of 0.1 W/kg or less, having an error ((Wmax−Wmin)/Wmin) of 0.1 or less, and superior in soft magnetic properties across the overall length of the strip can be obtained.

As opposed to this, as shown by Sample Nos. 18 to 28, when at least one element of P, Mn, and S is outside of the range of the present invention, there are portions where the watt loss is larger than 0.11 W/kg. The error ((Wmax−Wmin)/Wmin) also becomes 0.1 or more. Further, in Sample No. 18, the alloy cost ends up becoming higher.

From the above, it was learned that according to the present invention, a lower grade iron source than in the past can be used.

TABLE 6

| Sample | | Chemical composition (mass %) | | | Watt loss value (W/kg) | | |
|---|---|---|---|---|---|---|---|
| | No. | P | Mn | S | Wmax | Wmin | Error |
| Inv. | 1 | 0.008 | 0.22 | 0.006 | 0.098 | 0.091 | 0.08 |
| ex. | 2 | 0.013 | 0.20 | 0.008 | 0.094 | 0.088 | 0.07 |
| | 3 | 0.018 | 0.23 | 0.018 | 0.093 | 0.087 | 0.07 |
| | 4 | 0.022 | 0.35 | 0.009 | 0.094 | 0.087 | 0.08 |
| | 5 | 0.038 | 0.21 | 0.026 | 0.092 | 0.086 | 0.07 |
| | 6 | 0.046 | 0.48 | 0.008 | 0.096 | 0.090 | 0.07 |
| | 7 | 0.061 | 0.20 | 0.019 | 0.097 | 0.091 | 0.06 |
| | 8 | 0.082 | 0.16 | 0.004 | 0.098 | 0.091 | 0.08 |
| | 9 | 0.091 | 0.15 | 0.008 | 0.098 | 0.090 | 0.09 |
| | 10 | 0.100 | 0.21 | 0.007 | 0.099 | 0.092 | 0.08 |
| | 11 | 0.025 | 0.50 | 0.009 | 0.097 | 0.090 | 0.08 |
| | 12 | 0.031 | 0.27 | 0.038 | 0.096 | 0.089 | 0.08 |
| | 13 | 0.025 | 0.25 | 0.042 | 0.096 | 0.090 | 0.07 |
| | 14 | 0.018 | 0.38 | 0.050 | 0.098 | 0.091 | 0.08 |
| | 15 | 0.051 | 0.31 | 0.021 | 0.094 | 0.087 | 0.08 |
| | 16 | 0.073 | 0.23 | 0.031 | 0.097 | 0.090 | 0.08 |
| | 17 | 0.026 | 0.42 | 0.046 | 0.098 | 0.091 | 0.08 |
| Comp | 18 | <0.003 | <0.003 | <0.003 | 0.134 | 0.118 | 0.14 |
| ex. | 19 | 0.005 | 0.17 | 0.005 | 0.129 | 0.111 | 0.16 |
| | 20 | 0.007 | 0.21 | 0.008 | 0.123 | 0.108 | 0.14 |
| | 21 | 0.109 | 0.23 | 0.009 | 0.118 | 0.104 | 0.12 |
| | 22 | 0.112 | 0.16 | 0.004 | 0.121 | 0.107 | 0.13 |
| | 23 | 0.019 | 0.52 | 0.006 | 0.115 | 0.103 | 0.12 |

TABLE 6-continued

| Sample | Chemical composition (mass %) | | | Watt loss value (W/kg) | | |
|---|---|---|---|---|---|---|
| No. | P | Mn | S | Wmax | Wmin | Error |
| 24 | 0.023 | 0.58 | 0.010 | 0.119 | 0.107 | 0.11 |
| 25 | 0.021 | 0.25 | 0.052 | 0.124 | 0.110 | 0.13 |
| 26 | 0.023 | 0.23 | 0.061 | 0.131 | 0.116 | 0.13 |
| 27 | 0.035 | 0.53 | 0.053 | 0.138 | 0.121 | 0.14 |
| 28 | 0.110 | 0.21 | 0.051 | 0.141 | 0.123 | 0.15 |

1) In No. 18, the alloy cost ends up becoming higher.

INDUSTRIAL APPLICABILITY

The alloy strip of the present invention is improved in heat stability, amorphous phase forming ability, workability (brittleness), and watt loss due to the effect of addition of N. Further, it can be widely used as a soft magnetic material for the iron cores of power transformers and high frequency transformers and further the iron cores of magnetic shield materials etc.

The invention claimed is:

1. An Fe-based amorphous alloy strip characterized by containing, by atm %, B: 5 to 12%, Si: 1 to 5%, N: 0.001 to 0.2%, C: 1 to 10%, and P: 0.001 to 0.2%, and a balance of Fe and unavoidable impurities.

2. An Fe-based amorphous alloy strip superior in soft magnetic properties under an alternating current characterized by containing, by atm %, B: 12 to 16%, Si: 2 to 7%, N: 0.001 to 0.2%, Fe: 80 to 82%, and at least one of Co, Ni, and Cr: 0.01 to 1%, and further containing, by mass %, P: 0.008 to 0.1%, Mn: 0.15 to 0.5%, and S: 0.004 to 0.05%, and a balance of Fe and unavoidable impurities.

3. An Fe-based amorphous alloy strip superior in soft magnetic properties under an alternating current as set forth in claim 2 characterized by further containing, by atm %, C: 0.003 to 2%.

* * * * *